United States Patent [19]

Englander

[11] Patent Number: 4,836,523

[45] Date of Patent: Jun. 6, 1989

[54] MEDICAL OPERATING TABLE ATTACHMENT FOR SUPPORTING A PATIENT'S ARMS

[76] Inventor: Abe Englander, 12827 League St., North Hollywood, Calif. 91605

[21] Appl. No.: 219,211

[22] Filed: Jul. 15, 1988

[51] Int. Cl.[4] ..... A61G 13/00

[52] U.S. Cl. ..... 269/328

[58] Field of Search ..... 5/445, 436, 431; 269/322–328, 309, 900

[56] References Cited

U.S. PATENT DOCUMENTS

| | | | |
|---|---|---|---|
| D. 199,957 | 1/1965 | Bertaldo | 5/445 |
| 1,973,438 | 9/1934 | Lurba | 269/309 |
| 2,454,802 | 11/1948 | Hipps | 269/328 |
| 3,286,283 | 11/1966 | Bertoldo | 5/445 |
| 4,390,011 | 6/1983 | Evans | 269/328 |
| 4,561,549 | 12/1985 | Yokohori | 5/445 |
| 4,571,757 | 2/1986 | Zolecki | 269/328 |
| 4,642,824 | 2/1987 | Hodgeo | 5/445 |
| 4,715,592 | 12/1987 | Lewis | 269/328 |

FOREIGN PATENT DOCUMENTS

| | | | |
|---|---|---|---|
| 178046 | 2/1966 | U.S.S.R. | 269/328 |

*Primary Examiner*—Robert C. Watson

*Attorney, Agent, or Firm*—George J. Rubens

[57] ABSTRACT

An attachment is provided for medical operating type tables that will enable the hands and arms of a patient to be accommodated during operating procedures for reducing tension, anxiety, and fatigue that are normally experienced by a patient. The attachment comprises a pair of spaced apart posts adapted to receive the head of the patient therebetween. Each post is preferably an inverted U-shaped configuration secured to a support detachably mounted on an operating table. The inverted U-shaped post contains a variety of different oriented sections that can be gripped by the patient's hands so that the arms need not be maintained in a single position for long periods of time. The attachment posts also function to maintain a pillow in position the attachment support.

2 Claims, 2 Drawing Sheets

MEDICAL OPERATING TABLE ATTACHMENT FOR SUPPORTING A PATIENT'S ARMS

BACKGROUND OF THE INVENTION

This invention relates to medical operating-type tables, and more particularly to an attachment for such tables that will accommodate the hands and arms of the patient during various types of operating procedures to relieve stress and fatigue, and to make the patient more comfortable during long and complex operations and medical investigations.

In most operating procedures, the patient is placed on the operating table in a supine position. Regardless of whether the patient is administered an anesthetic or not during the operating procedure, the problem has always exists as to what the patient does with his or her arms, that is, where do they put their arms so that they are comfortable and do not interfere with the operating procedure. This problem is particularly vexing during coronary angioplasty and cardiac catheterization procedures where it is necessary for the patients to position their arms besides their heads in order to produce better pictures on their angiograms. In addition, in most operations, and especially during cardiac catheterization procedures, it is important that the patient is in a relaxed mood, and free of stress to facilitate the carrying out of such procedures, a condition that can only be achieved when the patient feels comfortable when on the operating table.

To date the problem of how to accommodate the arms and hands of the patient during operating procedures has not been addressed in the medical arts.

The present invention solves the above stated problem in effect by providing a device to accommodate the patient's arms by enabling the patient "to hang on to something" during long and complex operating procedures which also enables the attending doctor to expedite the procedure.

SUMMARY OF THE INVENTION

An attachment device is provided for medical operating-type tables that will accommodate the arms and hands of a patient while laying in a supine position during various types of operating procedures to enable the patient to be relaxed and free of tension during the procedure.

The attachment device comprises a pair of vertical posts spaced apart to accommodate the head of the patient therebetween. The posts are secured to a support that can be detachably mounted on an operating table in a position to accommodate the patient's arms. In a preferred embodiment, each post is constructed of an inverted U-shaped tubular member which provides additional lateral support, and a variety of different gripping surfaces for the patient's hands. This construction enhances the patient's feeling of "well being" by enabling the patient to vary the position of the arms during long and complex operations. The post support, which may be a plate or set of spaced rails, can be positioned on the operating table so that when the patient's hands are gripping the posts, the arms of the patient will be positioned behind the head to facilitate the insertion of catheters by the attending doctor.

OBJECTS OF THE INVENTION

A principal object of the present invention is to provide an operating table attachment device that will accommodate a patient's arms during an operating procedure to promote a feeling of well-being by the patient by relieving stress and fatigue.

Another important object is to provide such a device that will support the patient's arms in a position besides the head to facilitate the insertion of catheters by the attending doctor.

Still another important object is to provide such an attachment device that will offer a plurality of different hand gripping surfaces to enable the position of the patient's to be varied.

A further object of the invention is to provide such a device that can be readily attached and removed from the operating table in the event of an emergency.

DETAILED DESCRIPTION OF THE INVENTION

Figure 1:
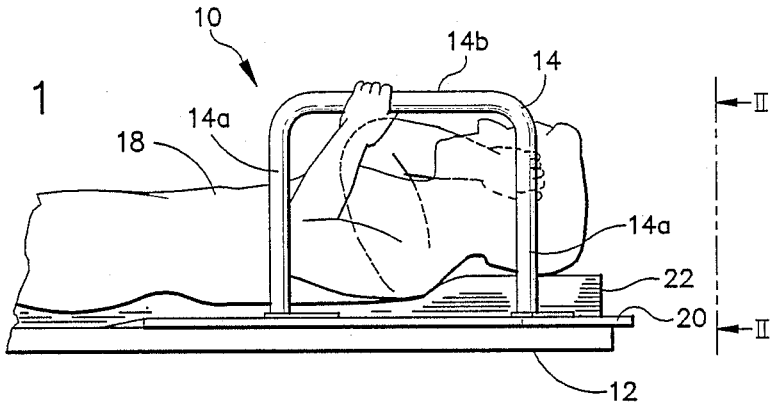
FIG. 1 is a side elevation view of the novel attachment device supported on a conventional medical operating type table with a patient supported between the attachment posts, and showing the patient's hands in solid lines gripping a horizontal section of the U-shaped attachment posts, and in broken lines the hands gripping a vertical section of the attachment posts.
Figure 2:
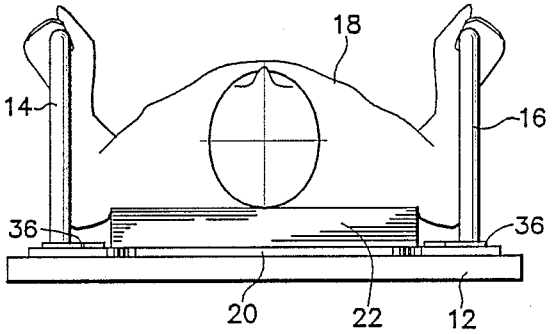
FIG. 2 is an end view of FIG. 1 taken along lines II—II.
Figure 3:
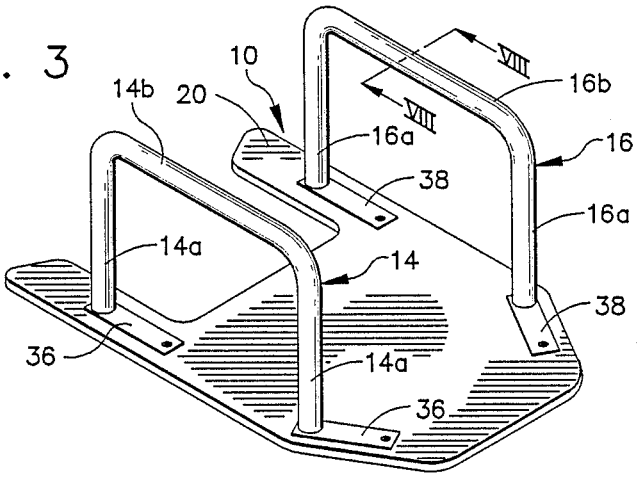
FIG. 3 is a perspective view of a preferred embodiment of attachment device in which the respective posts are U-shaped and secured to a supporting plate that can be placed on top of the operating table.

Referring to the drawing where like reference numerals refer to similar parts throughout the figures, there is shown in FIGS. 1 and 2 the novel patient arm supporting attachment 10 supported on a conventional medical operating table 12, of which only the top portion of the table is illustrated. As best shown in FIG. 3, attachment 10 comprises a pair of posts 14 and 16 spaced apart to receive the head of the patient 18 therebetween. In the preferred embodiment, each post is configured as an inverted U-shape, made preferably of stainless steel tubing. The U-shaped construction provides improved stability over a single post construction. In addition, the U-shaped construction forms vertical post sections 14*a*, 16*a* and horizontal post sections 14*b*, 16*b* that provide a plurality of different gripping surfaces for the patient's hands to grip, as shown both in solid lines and broken lines in FIG. 1. The availability of different gripping surfaces enables the patient to change positions to relieve tensions.

In FIGS. 1–3, posts 14 and 16 are mounted to a support 20, which may be a flat plate, as illustrated, made of metal, or clear plastic material for the passage of X-rays when angiograms are required.

Figure 4:
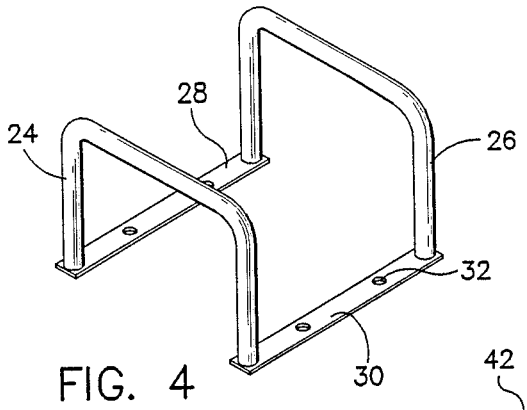
FIG. 4 is a perspective view of the attachment device in which the attachment posts are connected together in spaced relation by a pair of rails which can be secured to an operating table supporting plate.

Plate 20 is normally positioned freely between a conventional table pad 22 and table 12, as shown in FIGS. 1 and 2, enabling the attachment 10 to be quickly removed from the operating table in the event of an emergency, In FIG. 4, posts 24 and 26 are secured in spaced relation by a pair of rails 28 and 30 having bolt openings 32 by which the rails can be secured to certain types of medical table attachments having corresponding openings, not shown.

Figure 5:
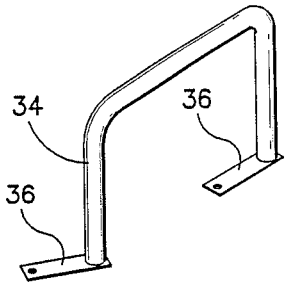
FIG. 5 is a similar view as FIG. 4 in which each post, one being shown, is supported by a pair of oppositely disposed lugs which can be secured to the operating table suppot plate.

FIG. 5 the posts, only one of the posts 34 being illustrated, are fabricated each with a pair of laterally extending lugs 36 and 38 for securing the respective posts medical table attachments. This construction enables the taking of X-rays without the interference of rails 28 and 30 of FIG. 4.

Figure 6:
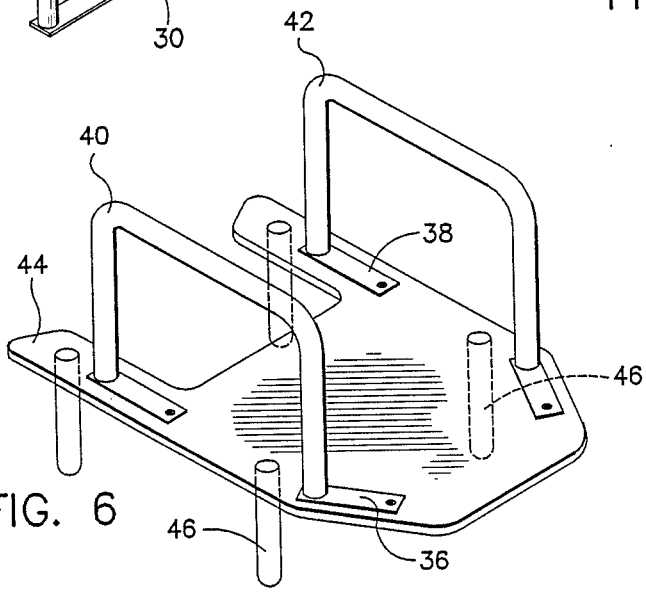
FIG. 6 is a perspective view similar to FIG. 3 in which a supporting plate has a plurality of depending pins adapted to engage apertures in certain types of operating tables.

In FIG. 6, posts 40 and 42 are secured to a plate 44, which also may be made of clear plastic, having a plurality of downwardly extending pins 46 adapted to be received in corresponding openings in certain types of tables and attachments.

Figure 7:
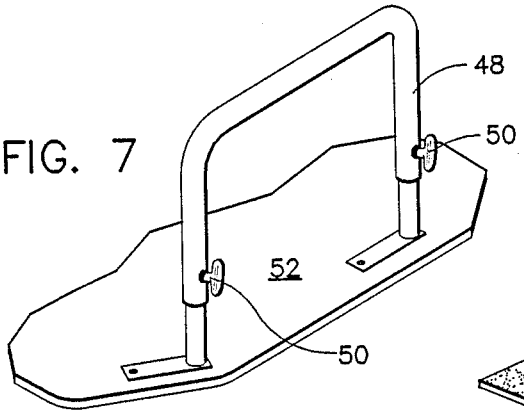
FIG. 7 is a perspective view of one of the attachment posts which is vertically adjustable to accommodate different size patients.

In FIG. 7, posts 48 are fabricated in a telescopic construction with thumb screws 50 provided for adjusting the height of the posts with respect to support 52, depending on the size of the patient, which feature also enhances the patient's comfort.

Figure 8:
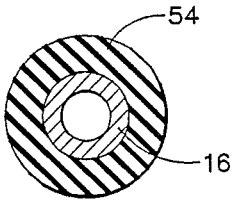
FIG. 8 is a cross-sectional view of an attachment post taken along line VIII—VIII of FIG. 3 showing an outer sponge-like covering.

In FIG. 8, tubular posts, i.e. 16, may be covered with a soft rubber cushion material 54 to comfort the patient's hands, especially from the cold metal feeling in an air condition area.

Figure 9:
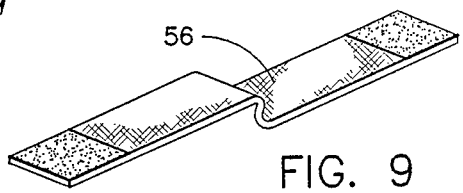
FIG. 9 is a plan view of a conventional "Velcro" strap which may be used to secure the patient's arm to the attachment when necessary.

In conclusion, the novel patient arm support attachment of the invention can be adapted to various types of medical operating tables and attachments on the market. It provides in essence, a means for the patient "to hold on to something" especially in certain operating procedures where the arms of the patient must be positioned besides the head. By providing a means for occupying the patien's hands and arms, the patient is made more comfortable and relaxed, which feeling reduces fatigue in an environment that is inherently stressful and full of anxiety. The novel arm support provides a means for supporting the patient's hands in a variety of positions, and also for securing the arms, which may be necessary in certain types of procedures, such as by "Velcro" straps 56 as shown in FIG. 9.

I claim:

1. A patient arm support loosely attached for medical operating type tables for reducing arm fatigue during operating procedures comprising:

two vertical posts;

said posts being attached to a base support for maintaining said posts in a spaced-apart upright position sufficient to receive the head of the patient therebetween;

said base support positionable on the operating table;

each of said posts having a horizontal portion spaced above the operating table sufficiently to be gripped by the hands of the patient during the operating procedures in a position besides the patient's head.

2. The attachment of claim 1 wherein said vertical posts and the horizontal portion are constructed as an inverted U-shaped loop.

3. The attachment of claim 1 wherein said base support is a flat plate adapted to be readily removably positioned on the table.

4. The attachment of claim 1 wherein said posts are covered with a sponge-like material comfortable to the hands of the patient.

5. The attachment of claim 2 wherein said posts are detachably mounted on the base support to facilitate removal of the patient in the event of an emergenvy.

6. The attachment of claim 2 wherein said posts are adjustable in height to accommodate the size of the patient.

7. The attachment of claim 3 wherein said flat plate is made of a material capable of transmitting X-rays.

8. The attachment of claim 1 wherein said base support is a plate having a plurality of depending pins adapted to be received by corresponding openings in the operating table.

9. The attachment of claim 1 wherein means are provided for restraining the hands of the patient to the posts.

10. A patient arm support attachment for medical operating type tables for reducing patient arm fatigue during vascular operating procedures comprising;

a pair of vertical posts positioned adjacent the head of the patient, each post being of an inverted U-shaped configuration having vertical and horizontal sections for gripping by the patient's hands;

said horizontal sections being sufficiently spaced above the table to be gripped by the hands of the patient during the operating procedures;

said posts being attached to a flat plate base support independent of the table for maintaining the posts in a spaced detachably secured upright position sufficient to receive the patient's head therebetween; and said posts of tubular construction and covered with a sponge-like material for comfort to the patient's hands.

11. The attachment of claim 10 wherein said posts are adjustable in height over the table so that the patient's arms will be comfortable, and will not interfere with any photographic operations.

* * * * *